US009333406B1

(12) United States Patent
Weeder

(10) Patent No.: US 9,333,406 B1
(45) Date of Patent: May 10, 2016

(54) RETRACTABLE BASKETBALL GOAL

(71) Applicant: Alan D. Weeder, Parker, CO (US)

(72) Inventor: Alan D. Weeder, Parker, CO (US)

( * ) Notice: Subject to any disclaimer, the term of this patent is extended or adjusted under 35 U.S.C. 154(b) by 153 days.

(21) Appl. No.: 13/969,461

(22) Filed: Aug. 16, 2013

Related U.S. Application Data

(60) Provisional application No. 61/768,461, filed on Feb. 23, 2013.

(51) Int. Cl.
*A63B 63/08* (2006.01)

(52) U.S. Cl.
CPC ..... *A63B 63/083* (2013.01)

(58) Field of Classification Search
CPC ..... A63B 63/08
USPC ..... 473/483, 484, 482, 479, 481; 248/596, 248/487, 125.7
See application file for complete search history.

(56) References Cited

U.S. PATENT DOCUMENTS 2,986,395 A * 5/1961 Sheftel ..... 473/483
4,465,277 A * 8/1984 Dittrich ..... 473/447
4,934,696 A * 6/1990 Jackan ..... 473/481
2004/0171441 A1* 9/2004 Pile ..... 473/479
2006/0116225 A1* 6/2006 Kilpatrick ..... A63B 63/083 473/483
2009/0069130 A1* 3/2009 Nye et al. ..... 473/484

* cited by examiner

*Primary Examiner* — Gene Kim
*Assistant Examiner* — Rayshun Peng
(74) *Attorney, Agent, or Firm* — Leyendecker & Lemire, LLC

(57) ABSTRACT

A retractable basketball goal and methods of use are described. Embodiments of the retractable goal are configured to alternately retract into a garage for storage and to extend out of the garage through a garage door opening for use. Embodiments typically include an anchor assembly, a goal assembly including a backboard and rim, and a support boom linking the anchor assembly to the goal assembly. The anchor assembly typically anchors the retractable goal in a garage, where the anchor assembly resides just inside a garage door opening proximate a garage parking space. The retractable basketball goal typically includes a retracted configuration wherein the retractable goal resides entirely within a garage with the backboard disposed substantially horizontally, and an operational configuration, wherein the goal assembly resides outside the garage, with the backboard disposed vertically.

15 Claims, 17 Drawing Sheets

RETRACTABLE BASKETBALL GOAL

The present application claims priority to and incorporates by reference U.S. provisional Patent Application No. 61/768,461, filed 23 Feb. 2013, having the same inventor and title as the present application.

BACKGROUND

Basketball goals installed or positioned proximate driveways are popular pieces of recreational equipment that enable playing basketball on driveways. Driveway basketball goals can be permanently installed or portable. However, some residential covenants and rules prohibit leaving a basketball goal visible proximate a driveway for multi-day intervals. Proscriptions against leaving the goals out over just one night are known.

Such covenants and rules often strictly prohibit permanently installed outdoor basketball goals proximate driveways. Conversely, portable units can be used on or proximate a residential driveway during the day and brought into a garage or otherwise moved to an inconspicuous location at night. However, portable goals tend to be large, heavy, or unwieldy, and are thus typically difficult to move. Some portable goals are prone to tipping over. Finding adequate space in the garage for storing the goals can also be difficult. A sturdy basketball goal that is alternately readily deployed for use and inconspicuously stored with ease is thus needed.

DETAILED DESCRIPTION

Figure 1:
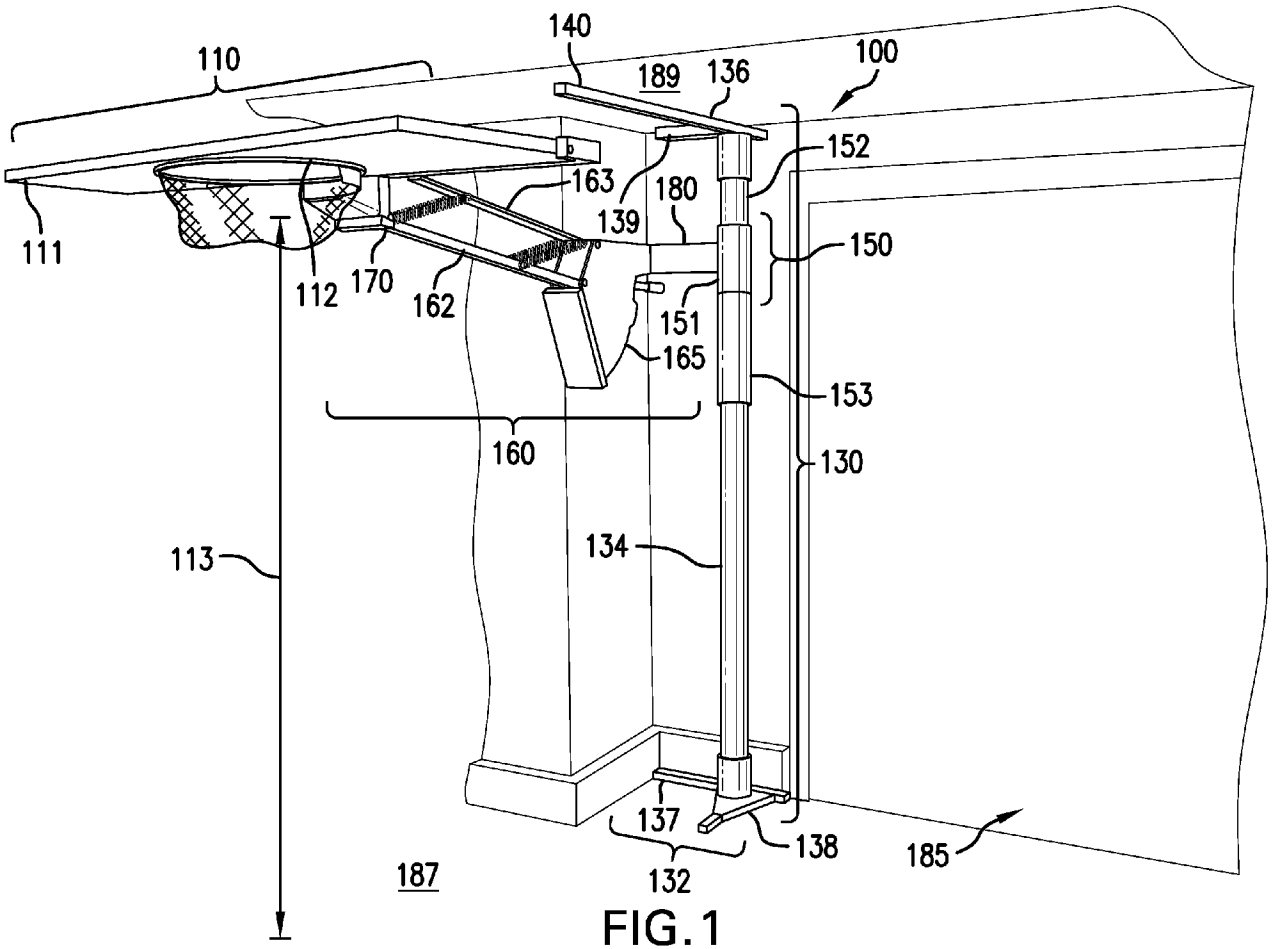
FIG. 1 is a perspective view from inside a garage, of a retractable basketball goal in a retracted configuration according to an embodiment.

Embodiments of the present invention include a retractable basketball goal, also referred to as a retractable goal. Embodiments of the retractable goal are designed and configured to alternately retract into a garage for storage and extend out of the garage through a garage door opening for use.

Embodiments typically comprise an anchor assembly, a goal assembly including a backboard and rim familiar to persons skilled in the art, and a support boom coupling the anchor assembly to the goal assembly. The anchor assembly is typically designed and configured to anchor the retractable goal in a garage, where the anchor assembly resides just inside a garage door opening proximate a garage parking space. The anchor assembly typically, but not necessarily, resides immediately adjacent to or beside the garage parking space. Embodiments include stand-alone retractable basketball goals that are unattached to or unaffiliated with a garage.

The retractable goal generally includes a retracted configuration wherein the retractable goal resides entirely within a garage, with the backboard disposed substantially horizontally. The rim is typically disposed substantially horizontally as well. The term substantially horizontal or horizontally means within 22.5° of horizontal. The term precisely horizontal or horizontally means within 5.5° of horizontal The retractable goal also typically includes an operational configuration, wherein the goal assembly resides outside the garage, with the backboard oriented precisely vertically and the rim oriented precisely horizontally. Precisely vertical or vertically means within 5.5° of vertical, and substantially vertical or vertically means within 22.5° of vertical. The operational configuration furthermore typically includes the rim residing at a rim height of about 10 feet. Rim height refers to a distance from a playing surface residing directly beneath the rim to a top of a circular portion of the rim, with 10 feet being an industry standard. Embodiments include operational configurations wherein the rim height is adjustable in a range from 6.5 feet to 10 feet. In the operational configuration, the support boom typically extends from the anchor assembly, through the garage door opening, to the goal assembly. In the operational configuration, the retractable basketball goal is available for shooting a basketball through the rim.

Embodiments include retractable goals installed, or designed and adapted to be installed, in a garage, and reconfigured from a retracted configuration to an operational configuration. Reconfiguration from a retracted configuration to an operational configuration can be referred to as deployment, deploying, or being deployed. Reconfiguring the retractable goal from the operational configuration to the retracted position can be referred to as retraction, retracting, or being retracted.

The retractable goal is typically reoriented from a retracted configuration to an operational configuration (deployment), or vice versa (retraction), with the goal assembly maintaining a clearance height during the deployment or retraction of preferably at least 5.25 feet, more preferably between 6.0 feet and 7.0 feet, still more preferably 6.25 feet and 7.0 feet, and most preferably about 6.5 feet. The retractable goal is thus capable of deployment and retraction without encroaching on the garage parking space, while still fitting beneath an open garage door, which typically resides at a height of about 7.0 feet. During deployment or retraction, the goal assembly typically traverses partially around the anchor assembly, above the parking space, until the goal assembly resides outside the garage. Accordingly, the retractable goal can typically deploy or retract with a car or other vehicle residing in the garage parking space. For exceptionally tall vehicles, such as some trucks, sport utility vehicles, or vehicles with structures mounted to the vehicle roof, deployment or retraction of the retractable basketball goal may not be possible, except where the vehicle has backed into the garage parking space such that the goal assembly passes over the vehicle hood. The goal assembly typically remains linked to the anchor assembly by the support boom while in retracted configuration, while in the operational configuration, and during deployment and retraction.

In some embodiments, the retractable goal assembly includes a safety switch that prevents the garage door from closing on the goal assembly when any part of the assembly extends through the garage door opening.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the numeric value provided.

The term "about," as used in this specification and appended claims, refers to plus or minus 20% of the value given.

The term "generally" as used in this specification and appended claims, mean mostly, or for the most part.

The terms "removable", "removably coupled", "removably installed," "readily removable", "readily detachable", "detachably coupled", "separable," "separably coupled," and similar terms, as used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

Directional or relational terms such as "top," bottom," "front," "back," "above," "beneath," and "below," as used in this specification and appended claims, refer to relative positions of identified elements, components, or objects, where the components or objects are oriented in an upright position as normally installed or used.

The term "garage parking space," as used in this specification and appended claims, refers to a three dimensional space projecting at least 15 feet into a garage from an associated garage door opening. The garage parking space typically projects into the garage perpendicular to the associated garage door opening. The garage parking space is typically the same width as the garage door opening, and in any event is at least 7 feet wide. The garage parking space typically extends from garage floor height to 5.0 feet above the garage floor.

A First Embodiment Retractable Basketball Goal

A first embodiment retractable basketball goal 100 is illustrated in FIGS. 1-12. The first embodiment retractable goal comprises a goal assembly 110, an anchor assembly 130, and a support boom 160. The goal assembly 110 includes a backboard 111 and a rim 112, and the anchor assembly 130 includes a base 132, a tower 134, and an upper brace 136. The support boom 160, which links the goal assembly 110 to the anchor assembly 130, includes a first boom arm 162, a second boom arm 163 disposed precisely parallel to the first boom arm 162, a height adjustment mechanism 165, and a bent portion 180. Precisely parallel means within 5.5° of parallel. Substantially parallel means within 22.5° of parallel. The second boom arm 163 resides directly above the first boom arm 162.

The support boom 160 is pivotably coupled to the tower 134 at a pivoting connection 150. The pivoting connection 150 comprises an outer sleeve 151 and a portion of the tower 134 surrounded by the outer sleeve 151. Both the tower 134 and the outer sleeve 151 of the first embodiment are typically cylindrical, which facilitates the outer sleeve rotating on the portion of the tower contained within. The outer sleeve 151 is supported on the tower 134 by a support sleeve 153. The support sleeve 153 is secured in place on the tower 134 by one or more set screws 154 (best shown in FIG. 4).

As shown in FIG. 1, the retractable basketball goal 100 resides in a retracted configuration, with the goal assembly 110 residing inside a garage and the backboard 111 in a substantially horizontal orientation. The goal assembly 110 in FIG. 1 resides at a clearance height 113 of about 7.0 feet. Retracted configuration clearance heights reside in a range of preferably 5.5 feet to 9.0 feet, more preferably 6.0 feet to 7.5 feet, and most preferably 6.25 feet to 7.0 feet. Clearance height 113 refers to a distance from the garage floor surface 187 directly beneath the goal assembly 110 to a bottom-most portion of the goal assembly. Clearance height does not include a basketball net. The net can project below the clearance height without detriment because the net will yield when contacting an object such as a car residing in the garage or driveway beneath the goal assembly 110. In some embodiments, the net can be retracted so it does not extend below the rim 112.

Figure 2:
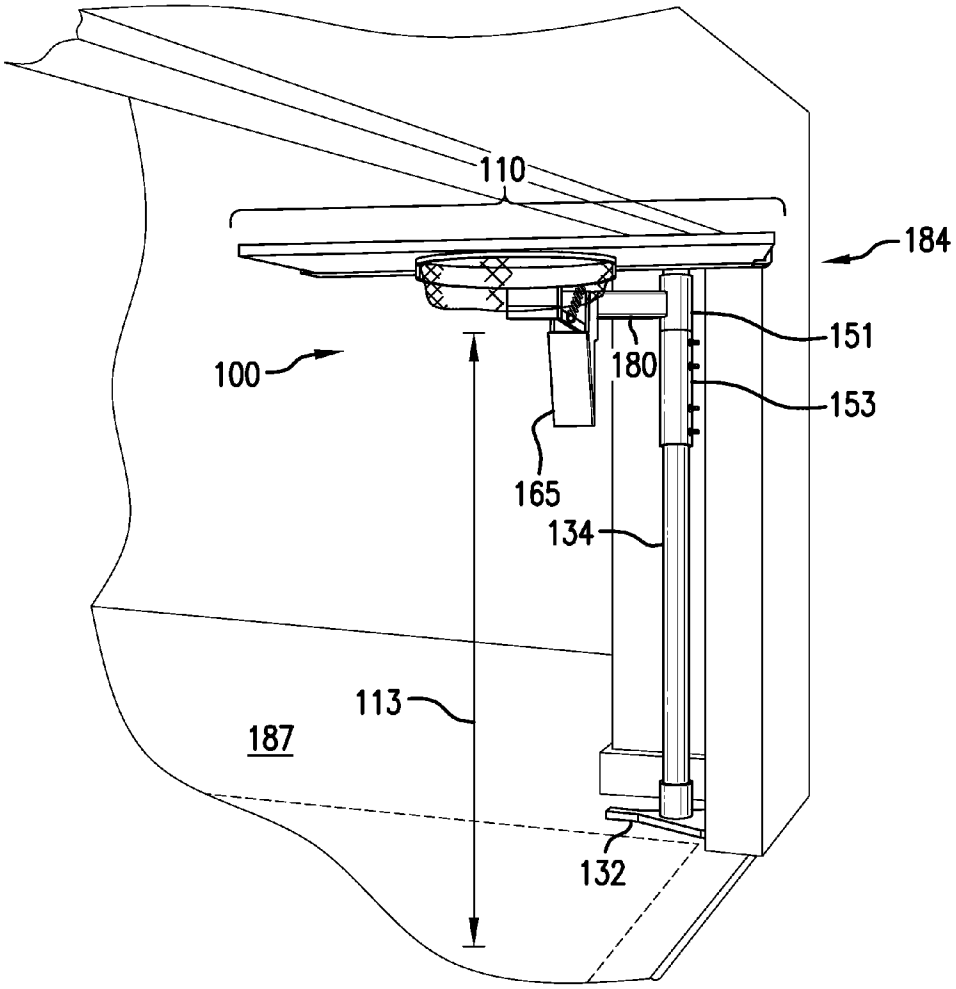
FIG. 2 is a perspective view from outside a garage, of a partially deployed retractable basketball goal according to an embodiment.
Figure 3:
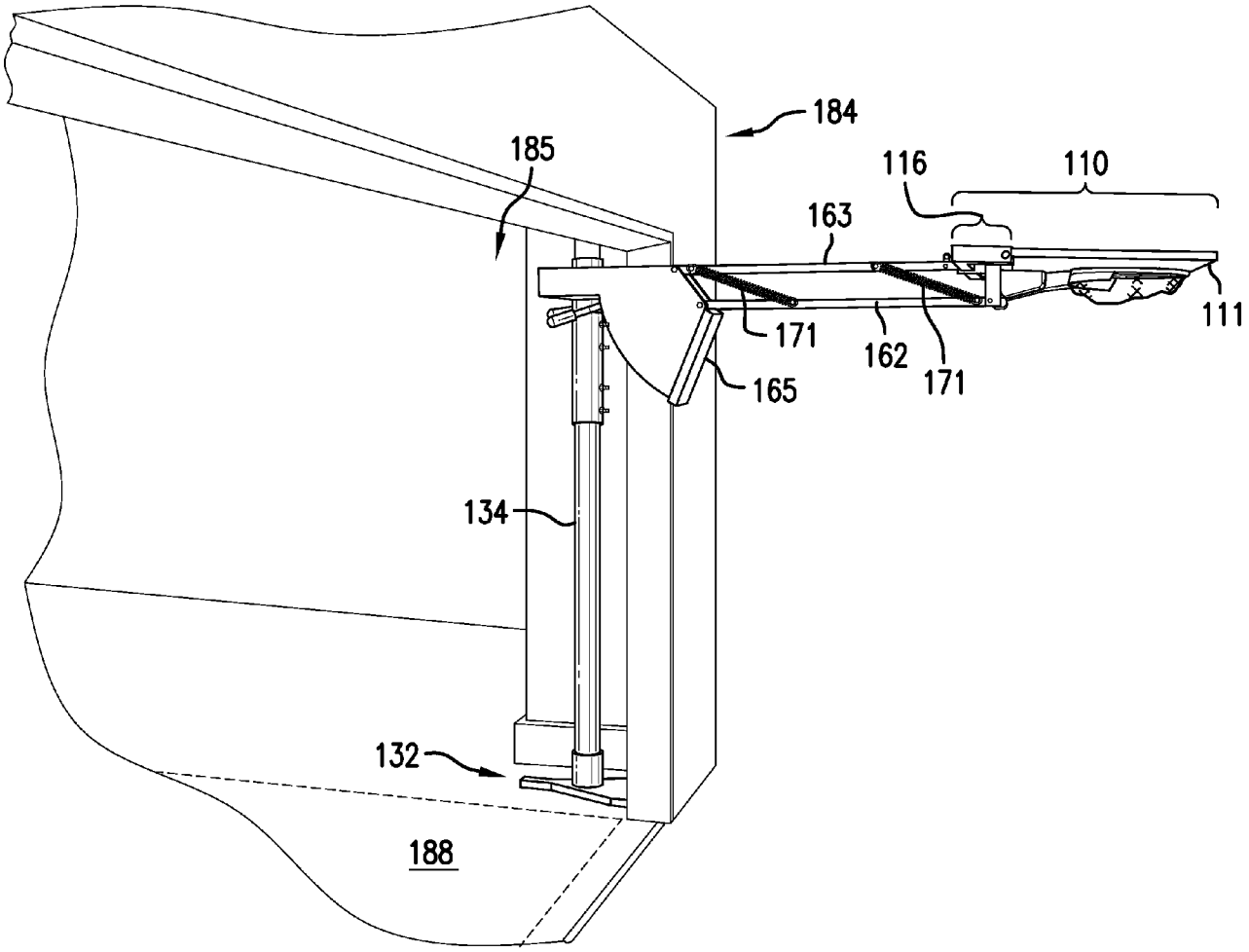
FIG. 3 is a perspective view from outside a garage, of a partially deployed retractable basketball goal according to an embodiment.
Figure 12:
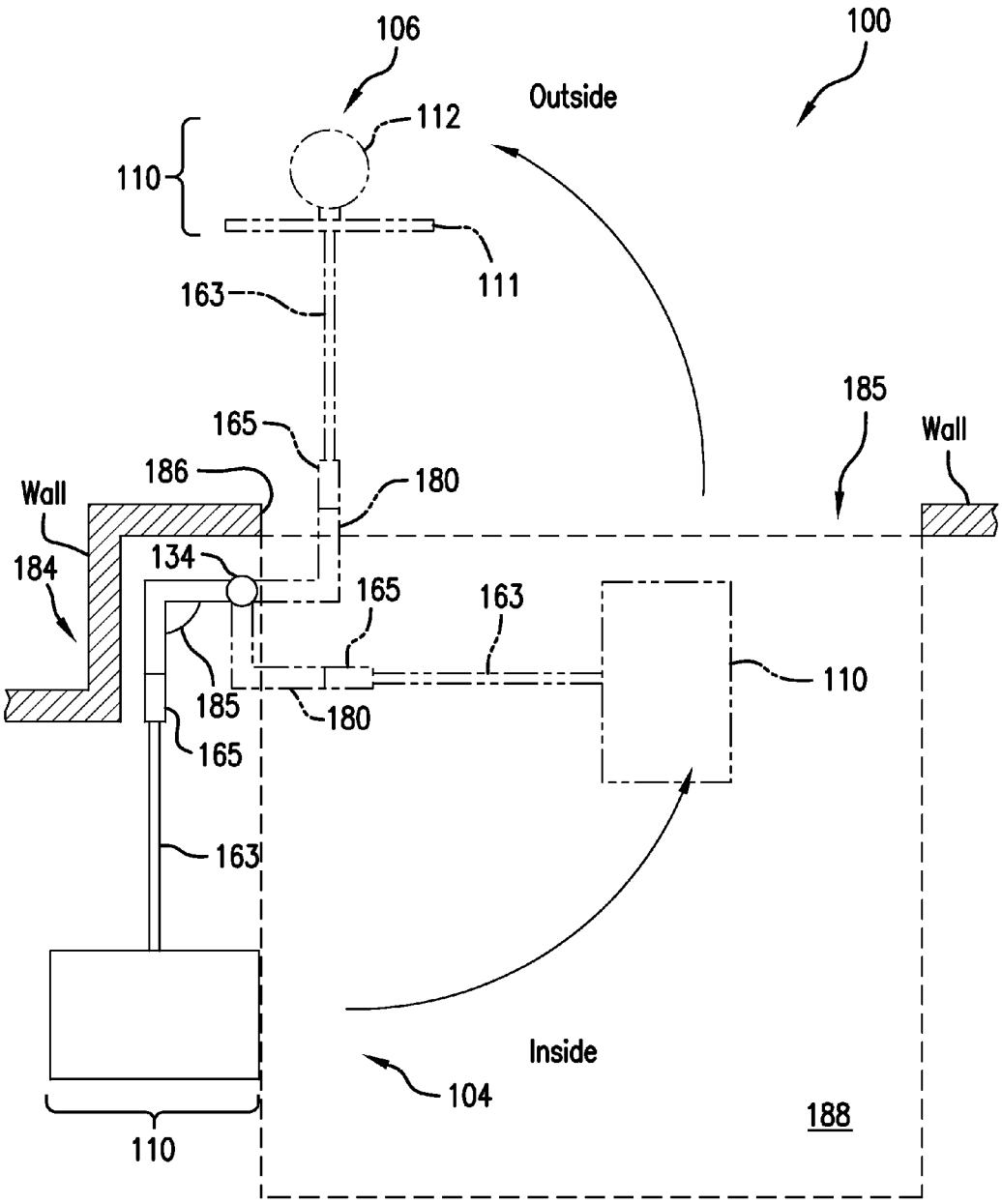
FIG. 12 is a top, plan view showing a retractable basketball goal in a fully retracted, a partially deployed, and a fully deployed (operational) configuration, according to an embodiment.

As shown in FIG. 2, the retractable basketball goal 100 is partially deployed, with the goal assembly 110 residing partially within the garage, and extending out through a garage door opening. The garage door opening is identified by reference character 185 in FIGS. 1 and 12. The clearance height 113 of the goal assembly is about 6.25 feet, the goal assembly having been lowered slightly from the configuration shown in FIG. 1 in order to fit through the garage door opening 185. With a clearance height 113 of about 6.25 feet, the goal assembly remains high enough to pass over a typical motor vehicle residing in the garage parking space 188. The garage parking space 188 is best shown in FIGS. 3 and 12. Embodiments include a protective net that can be deployed across the garage door opening to prevent an errant basketball from striking a motor vehicle residing in the garage parking space.

The retractable basketball goal 100 is shown partially deployed in FIG. 3, with the entire goal assembly 110 residing outside the garage 184, but with the backboard 111 remaining disposed substantially horizontally. In order for the support boom 160 and goal assembly 110 to move from the retracted configuration illustrated in FIG. 1, to the partially deployed configuration illustrated in FIG. 3, the support boom 160 revolves around the tower 134, with the outer sleeve 151 rotating around a portion of the tower 134 residing within the outer sleeve.

Figure 4:
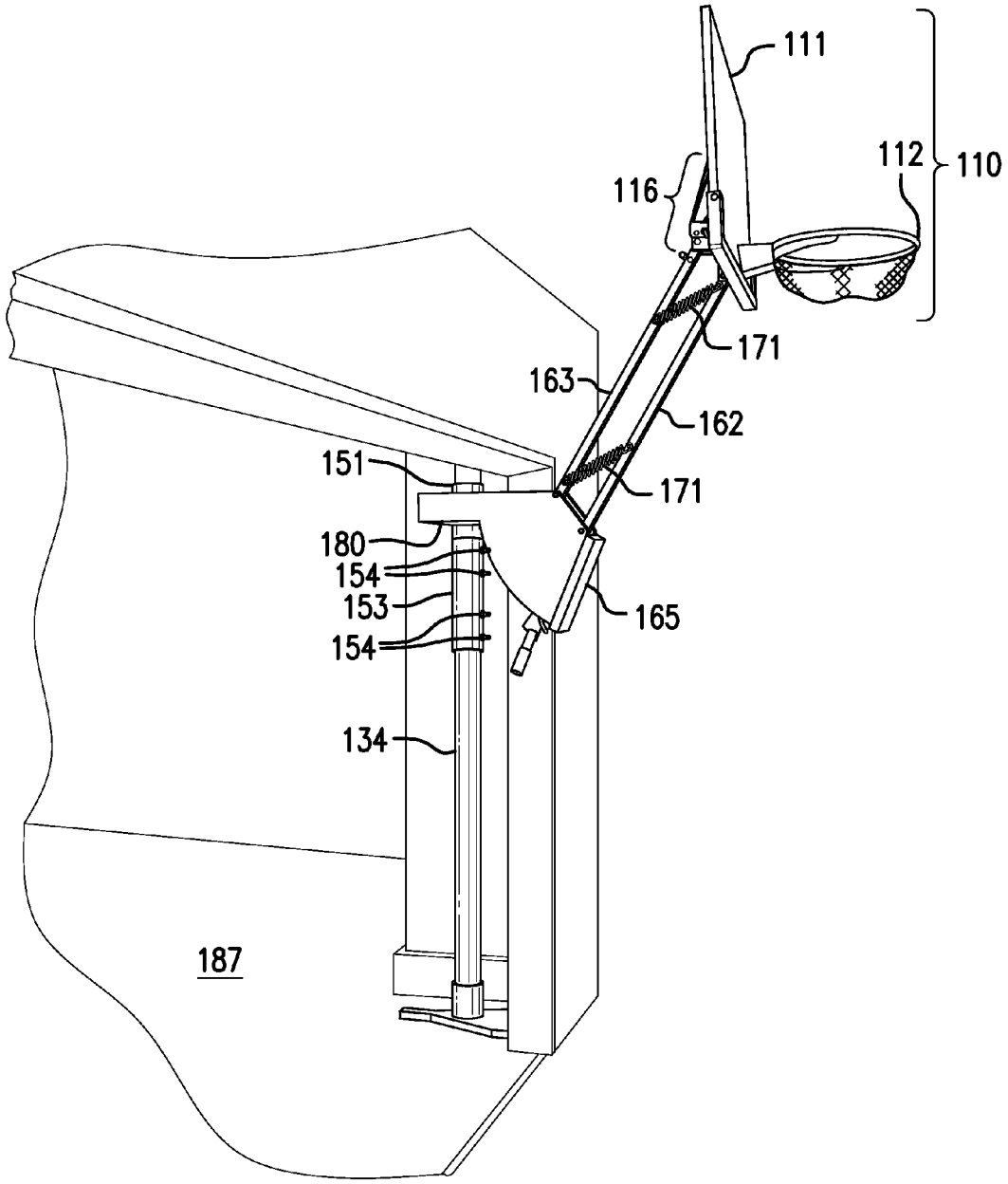
FIG. 4 is a perspective view from outside a garage, of a retractable basketball goal in an operational configuration according to an embodiment.
Figure 5:
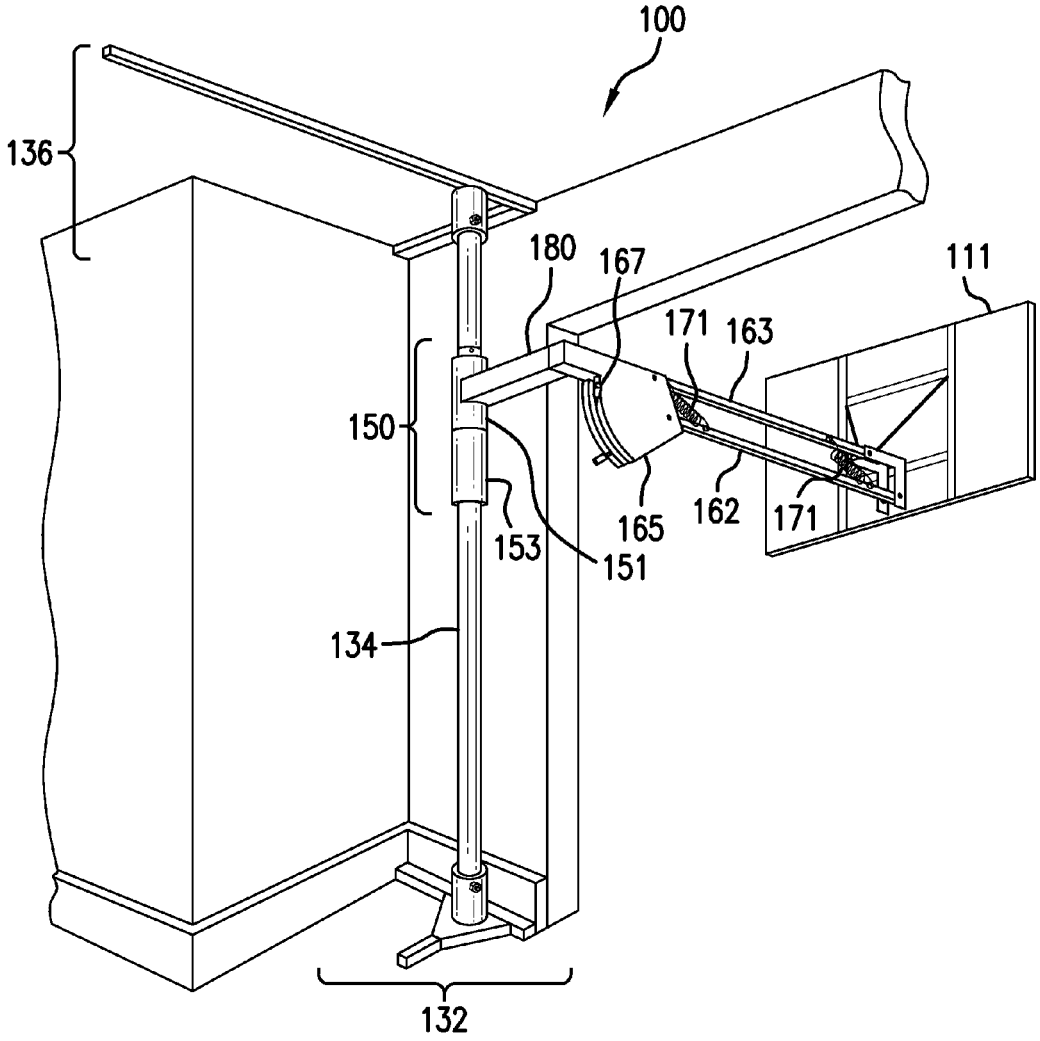
FIG. 5 is a perspective view from inside a garage, of a retractable basketball goal in an operational configuration according to an embodiment.
Figure 6:
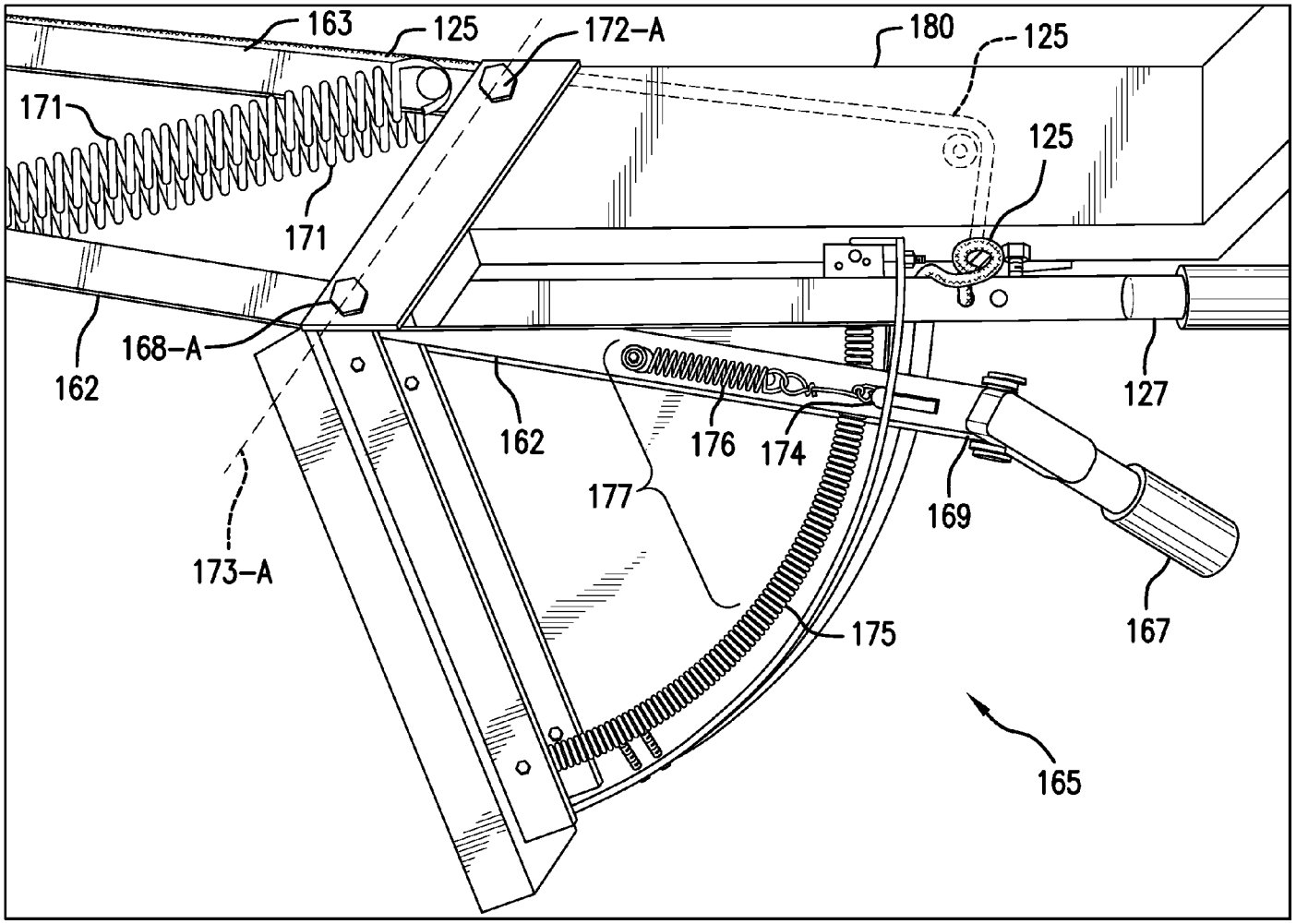
FIG. 6 is a perspective view of a height adjustment mechanism with its cover removed, according to an embodiment.

FIGS. 4 and 5 show the retractable goal 100 in an operational configuration with the backboard 111 in a precisely vertical orientation. The goal assembly 110 is shown raised in FIG. 4. Raising the goal assembly 110 is performed by pressing down on an adjustment handle 167. As best shown in FIG. 6, which is a view of the height adjustment mechanism 165 with a cover removed to expose internal components, the adjustment handle 167 is coupled directly to a proximal end 169 of the first boom arm 162.

Figure 7:
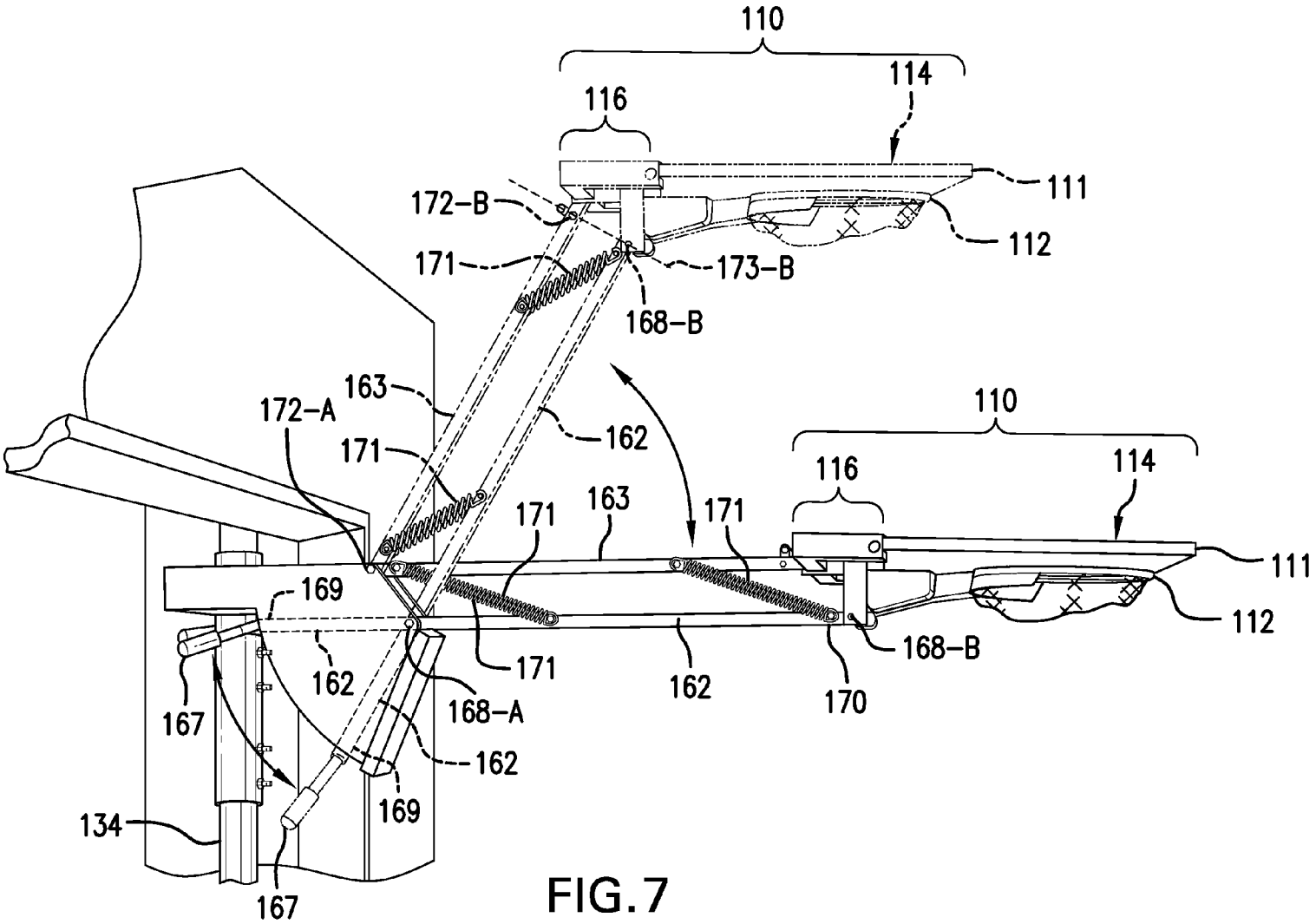
FIG. 7 is a perspective view of a partially deployed retractable basketball goal in a low position and a high position, according to an embodiment.

As best seen in FIGS. 6 and 7, lowering the adjustment handle 167 causes the first boom arm 162 to rotate on a first boom arm proximal pivot member 168-A, such that a distal end 170 of the first boom arm 162 rises as the handle 167 and proximal end 169 lower. A bolt typically serves as the first boom arm proximal pivot member 168-A, which acts as a fulcrum for the first boom arm 162 as it raises and lowers the goal assembly 110. At its distal end 170, the first boom arm 162 is pivotably attached to the goal assembly 110 by a first boom arm distal pivot member 168-B. The second boom arm 163 remains precisely parallel to the first boom arm 162 as the goal assembly 110 rises and lowers. The second boom arm 163 rotates around a second boom arm proximal pivot member 172-A and a second boom arm distal pivot member 172-B as it rises and lowers.

As best shown in FIG. 6, the first boom arm proximate pivot member 168-A and second boom arm proximate pivot member 172-A typically reside on a straight line referred to as a boom arm proximal pivot pair line 173-A. The boom arm proximal pivot pair line 173-A is typically oriented in a range that is preferably 17° to 60° from vertical, more preferably 25° to 53° from vertical, still more preferably 30° to 43° from vertical, and most preferably approximately 34° from vertical.

As best shown in FIG. 7, the first boom arm distal pivot member 168-B and second boom arm distal pivot member 172-B typically reside on a straight line referred to as a boom arm distal pivot pair line 173-B. The boom arm distal pivot pair line 173-B is preferably substantially parallel to, and more preferably precisely parallel to, the boom arm proximal pivot pair line 173-A. Horizontal/vertical orientation of the boom arm distal pivot pair line and boom arm proximal pivot pair line typically remains unchanged as the boom arms raise and lower.

As best seen in FIG. 7, the goal assembly 110 rises with the distal end 170 as the adjustment handle 167 lowers, an action aided by the lift assist members 171, which are attached to the first boom arm 162 and the second boom arm 163, and extend therebetween. The lift assist members of the first embodiment are typically tension springs. Other lift assist members include pneumatic cartridges and hydraulic cylinders. The lift assist members typically apply tensile force between the first boom arm 162 and the second boom arm 163. The first and second boom arms change positions, relative to each other, moving in opposite directions along their respective longitudinal axes, as the goal assembly 110 raises or lowers. This causes the lift assist members 171 to compress as the goal assembly 110 raises, which relieves some tension on the springs. The lift assist members thus help lift the goal assembly. Conversely, as the goal assembly lowers, the lift assist members 171 stretch, and resistance of the springs to stretching helps prevent the goal assembly from lowering too quickly or forcefully. FIG. 7 shows that the lift assist members 171 are relatively compressed with the goal assembly 110 raised, and are relatively stretched with the goal assembly 110 lowered.

As best seen in FIG. 6, the height adjustment mechanism 165 includes a locking pin 174 configured to reversibly engage a curved threaded rod 175 in order to lock the height adjustment mechanism at a given height. Secure engagement of the threaded rod 175 by the locking pin 174 is encouraged by a locking spring 176, which pulls the locking pen fast against the threaded rod. The locking pin 174, curved threaded rod 175, and locking spring 176 collectively form a height locking assembly 177.

The goal assembly 110 further includes a backboard lift mechanism 116 configured to adjust the backboard 111 from a substantially horizontal configuration to a precisely vertical orientation, from a precisely vertical orientation to a substantially horizontal configuration, and multiple orientations between horizontal and vertical.

As best seen in FIGS. 8-11, the backboard lift mechanism 116 comprises a swingarm 119 and a lift bracket 122. Backboard struts 124 project from the lift bracket 122 to the backboard, and are pivotably coupled directly to an upper portion of the backboard on a first end 124A, and pivotably coupled directly to the lift bracket 122 at a second end 124B. The lift bracket 122 is pivotably coupled to the swingarm 119.

Figure 8:
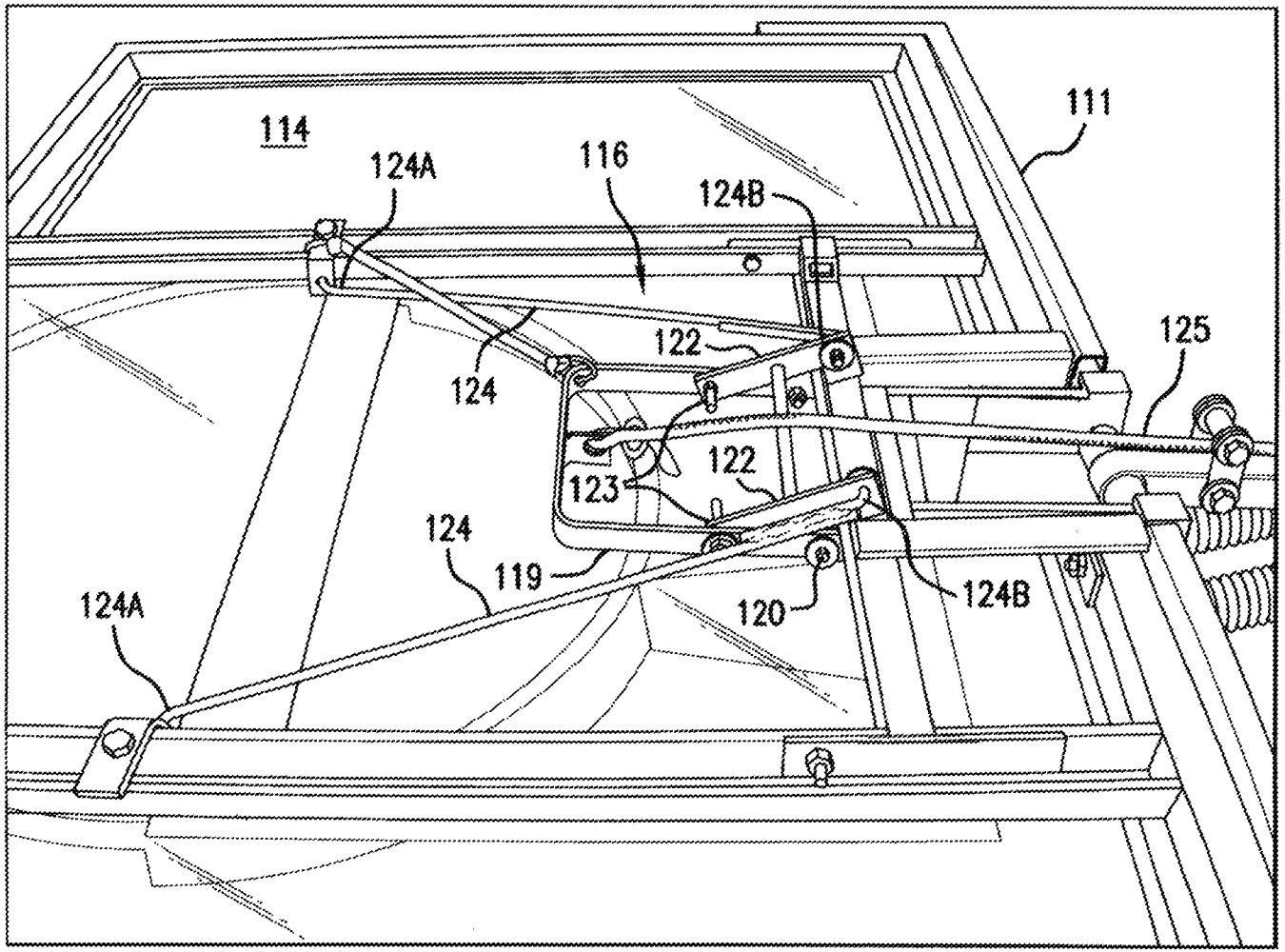
FIG. 8 is a perspective view of a goal assembly in its thinnest configuration, according to an embodiment.
Figure 9:
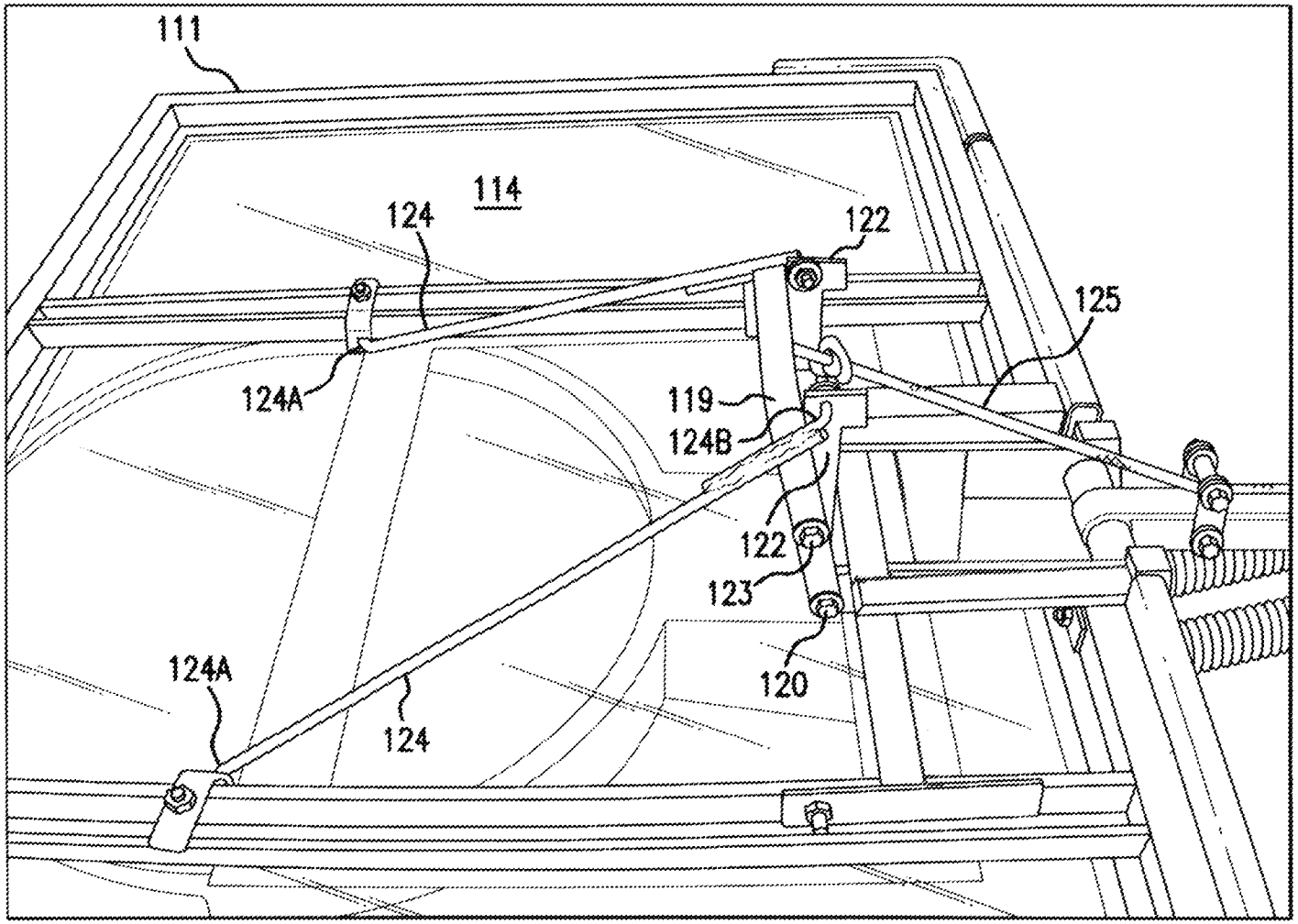
FIG. 9 is a perspective view of a goal assembly according to an embodiment.
Figure 10:
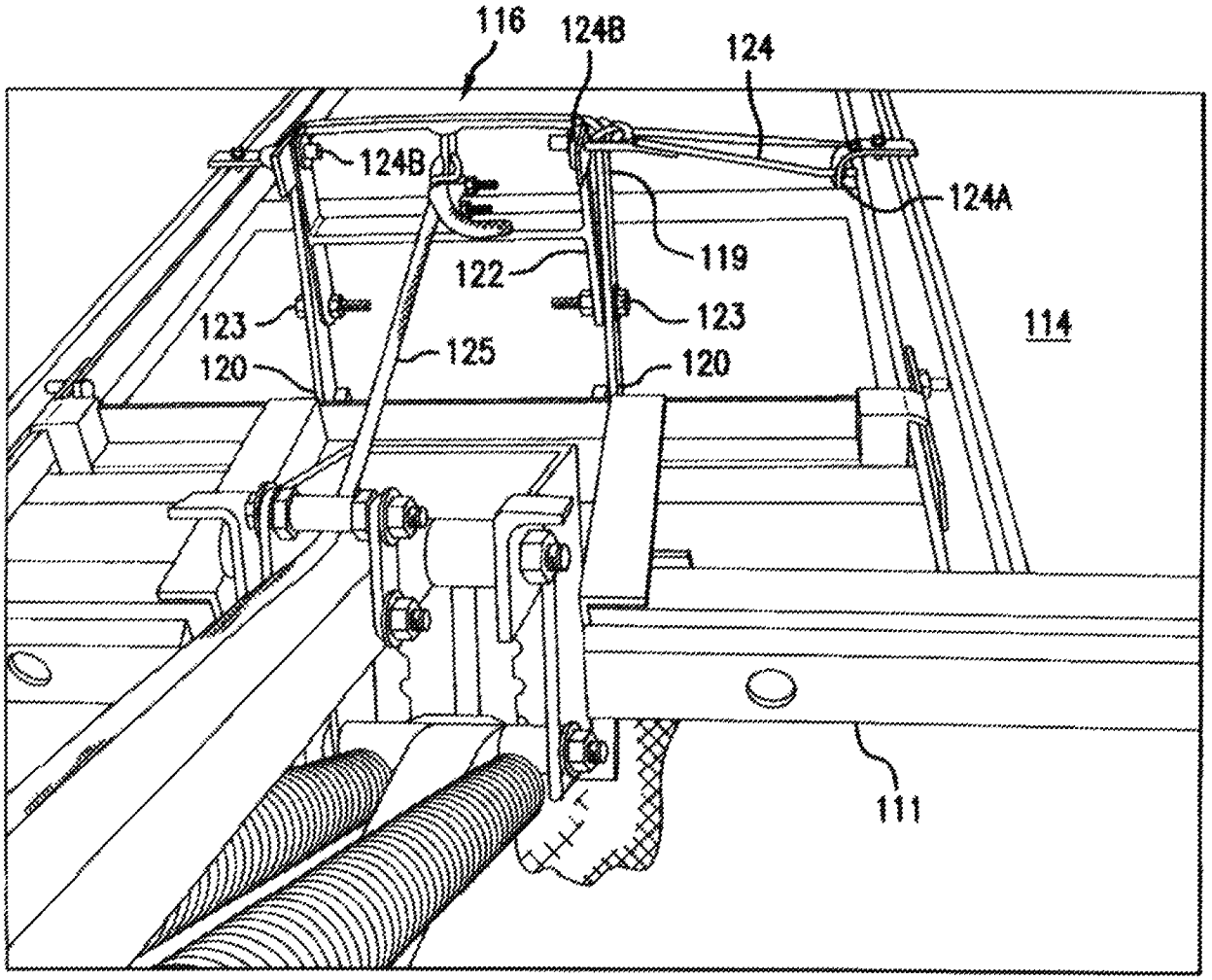
FIG. 10 is a perspective view of a goal assembly according to an embodiment.
Figure 11:
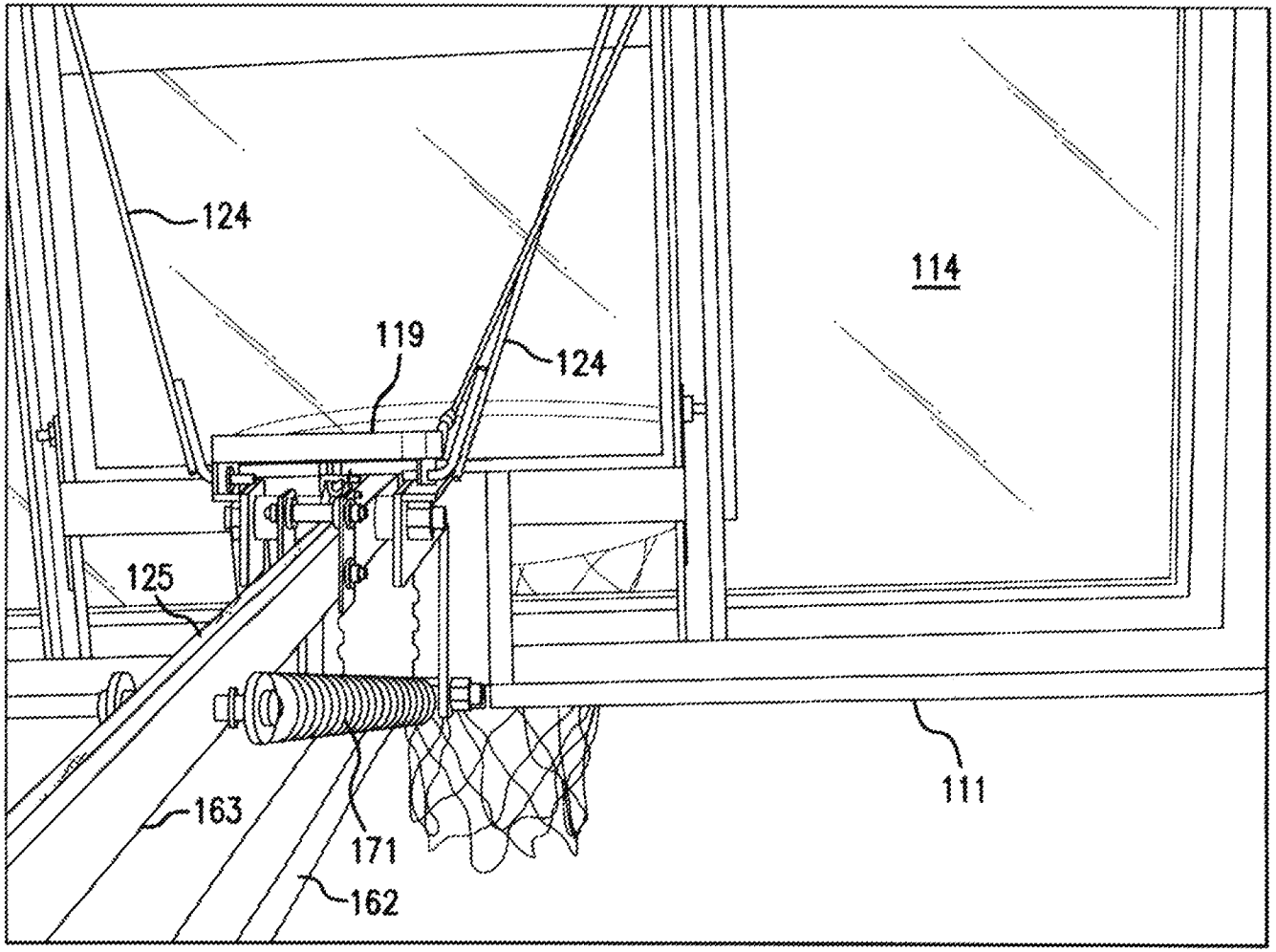
FIG. 11 is a perspective view of a goal assembly according to an embodiment.

FIGS. 8-11 illustrate the backboard 111 adjusting from a substantially horizontal orientation (FIG. 8) to a precisely vertical orientation (FIG. 11). In FIG. 8, the swingarm 119 resides relatively flat against the backboard 111, with both the swingarm and the backboard being oriented substantially horizontally. So oriented, the backboard lift mechanism typically projects upwardly less than 2.5 inches from a back surface 114 of the backboard 111. In some embodiments, the backboard lift mechanism preferably projects upwardly less than 6.0 inches, and most preferably less than 4.0 inches, from a back surface 114 of the backboard 111 when the backboard is oriented substantially horizontally and the swingarm 119 resides relatively flat against the backboard back surface 114, as shown in FIG. 8. Accordingly, as illustrated in FIG. 8 with the backboard oriented substantially horizontally and the backboard lift mechanism 116 laying relatively flat against the backboard back surface 114 (referred to as the goal assembly's thinnest configuration), the goal assembly of the first embodiment is approximately 6.0 inches thick not including the net.

Thus when the first embodiment retractable basketball goal 100 is fully or partially retracted, with the goal assembly 110 in its thinnest configuration and residing at a clearance height 113 of 6.4 feet, the goal assembly 110 will typically fit beneath a garage door residing at 7.0 feet above the garage floor. An embodiment of a goal assembly 110 in its thinnest configuration is preferably less than 18.0 inches tall, more preferably less than 12.0 inches tall, and most preferably between 8.0 inches and 5.0 inches tall.

FIG. 9 shows an initial phase of backboard adjustment, initiated by tension being applied to the backboard lift line 125, which is coupled directly to the swingarm 119. Tension on the lift line 125 lifts a free end of the swingarm 119, which rotates around a swingarm pivot 120, by which the swingarm is pivotably coupled to the backboard 111. Lifting and rotating of the swingarm 119 causes a lift bracket pivot 123 to move away from the backboard strut first end 124A, which generates tension on the struts 124, which results in the lift bracket 122 rotating around the lift bracket pivot 123.

As best seen in FIGS. 10 and 11, as the swingarm 119 further rotates around the swingarm pivot 120, the lift bracket 122 continues to rotate around the lift bracket pivot 123 until further rotation of the lift bracket 122 is obstructed by the swingarm 119, whereupon further rotation of the swingarm causes the backboard struts 124 to pull upwardly on the upper portion of the backboard. Consequently, the backboard begins to adjust from a substantially horizontal orientation as it rotates around a backboard pivot axis. The backboard pivot axis 226 is best viewed in FIG. 17.

In order to adjust the backboard 111 to a precisely vertical orientation, tension is applied to the backboard lift line 125 by lowering a backboard lift lever 127. As best seen in FIG. 6, the backboard lift lever 127 resides proximate or within the height adjustment mechanism 165. The backboard lift line 125 is coupled directly to the backboard lift lever 127, and lowering the lift lever 127 applies tension to the lift line, which in turn adjusts the backboard horizontal/vertical orientation as described above. The backboard lift line 125 of the first embodiment retractable basketball goal 100 typically comprises nylon, polyolefin, or polyester rope. Other lift line embodiments include, but are not limited to, rope, cable, wire, braided line, monofilament line, and other materials.

Figure 13:
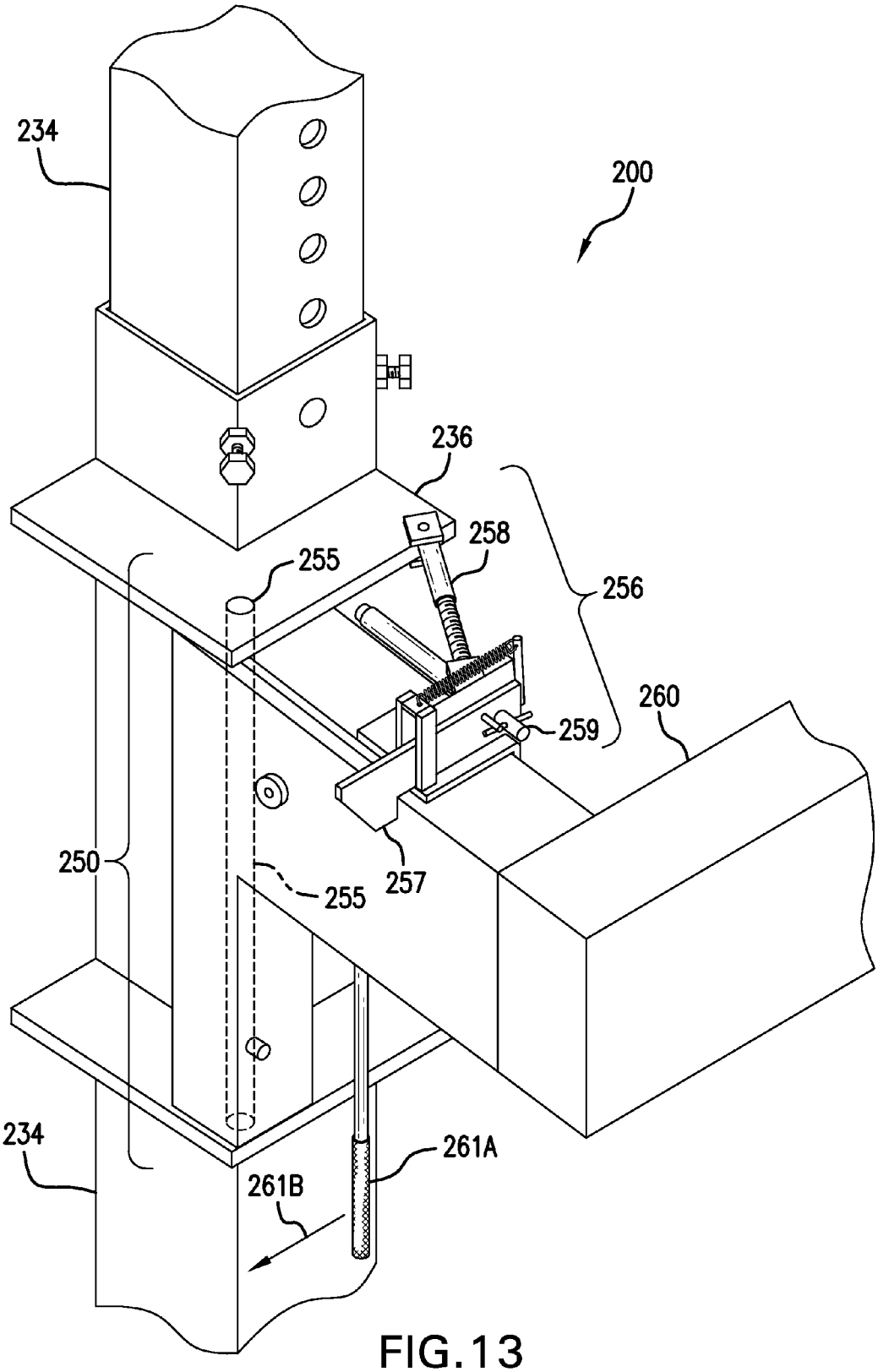
FIG. 13 is a perspective view of a pivoting connection between a support boom and tower, according to an embodiment.

FIG. 12 illustrates movement of the goal assembly 110 from a fully retracted configuration 104 to an operational configuration 106. The movement typically includes the goal assembly 110 revolving along an arc around the pivoting connection 150 and the support boom 160 rotating around the pivoting connection 150. In the fully retracted configuration the goal assembly resides within the garage 184 and in the operational configuration the goal assembly resides outside the garage 184. The pivoting connection 150 is a means by which the support boom 160 rotates precisely horizontally around the tower 134, and is best shown in FIGS. 1 and 5. An alternative embodiment of a pivoting connection 250 is illustrated in FIG. 13. As best seen in FIG. 12, the bent portion 180 enables the support boom to reach around a garage door opening boundary 186.

The bent portion 180 of the first embodiment retractable basketball goal 100 includes a first section and a second section, which meet at a horizontal bent arm angle 185 of approximately 90°. The horizontal bent arm angle is preferably less than 180°, more preferably between 45° and 180°, still more preferably between 60° and 120°, and most preferably about 90°. In some embodiments, the bent portion includes a curved arm section instead of or in addition to first and second sections meeting at a bent arm angle <180°. Bent portions are horizontally curved or have a horizontal bent arm angle that is less than 180°, such that the support boom of which the bent portion is a part projects along a bent or curved horizontal path.

As best seen in FIG. 1, the anchor assembly 130 of the first embodiment retractable basketball goal 100 is typically secured in place on the garage floor 187 by being wedged between the floor 187 and the garage ceiling 189, with the base 132 resting on the floor and the upper brace 136 pressed against the ceiling 189. The base includes a first base leg 137 with a second base leg 138 projecting substantially perpendicular therefrom, and the tower 134 coupled to the base at a position offset from the ends of both the first and second base legs. Accordingly, were the anchor assembly to begin to tilt in any direction, the first or second base leg would leverage the tower 134 upwardly, which motion would be impeded by the upper brace 136 pushing against the garage ceiling 189. Substantially perpendicular means within 22.5° of perpendicular. Precisely perpendicular means within 5.5° of perpendicular. As shown in FIG. 1, the base effectively occupies less than 2 square feet of garage floor area.

Similarly, the upper brace includes a first brace arm 139 with a second brace arm 140 projecting substantially perpendicular therefrom, and the tower 134 coupled to the upper brace at a position offset from the ends of both the first and second brace arms. Accordingly, were the anchor assembly to begin to tilt in any direction, the first or second brace arm would leverage the tower 134 downwardly, which motion would be impeded by the base pushing against the garage floor 187. Actions of the base 132 and upper brace 136 against the garage floor 187 and ceiling 189, respectively, therefore prevent the tower 134 from tilting appreciably, and the anchor assembly 130 is thus anchored in place, wedged securely between the garage floor 187 and ceiling 189. The second brace arm 140 is typically at least 36 inches long in order to span at least 2 trusses or joists in the garage ceiling where the trusses or joists run perpendicular to the second brace arm. Height of the anchor assembly 130 is typically adjustable to facilitate placing the upper brace 136 firmly against the garage ceiling 189.

A Second Embodiment Retractable Basketball Goal

A second embodiment retractable basket ball goal 200 is shown in FIGS. 13-17. The second embodiment retractable basketball goal 200 typically includes a tower 234 with a rectangular transverse cross-section, as opposed to the cylindrical tower 134 (best seen in FIGS. 1-5) of the first embodiment. Other embodiments have towers with transverse cross-sections that are polygons or other simple closed figures. The second embodiment basketball goal 200 further comprises a pivoting connection 250 including a support boom pivot pin 255 coupled to and offset from the tower 234, as best shown in FIG. 13. The support boom pivot pin 255 resides on an axis of rotation for the support boom 260. The support boom pivot pin 255 is typically oriented precisely vertically, and is offset from the tower by preferably between 12.0 inches and 0.25 inch, more preferably between 6.0 inches and 0.50 inch, and most preferably between 1.0 and 2.0 inches. The pivoting connection 250 acts as a hinge, and enables the support boom 260 to rotate precisely horizontally about the support boom pivot pin 255 as the goal assembly revolves around the pin 255.

The second embodiment retractable basketball goal further includes a support boom locking assembly 256 that locks the support boom 260 in place when deployed, thereby preventing horizontal rotation of the support arm. The support boom locking assembly 256 includes a hook 257 that engages the support boom 260 to prevent horizontal rotation in a first direction (in this case, preventing clockwise rotation). The locking assembly 256 further comprises an adjustable member 258 coupled to a tower flange 236. The adjustable member 258 includes a threaded fitting configured to enable adjusting the length of the member 258. Altering the length of the adjustable member 258 changes the angle between the support boom 260 and the tower 234. The angle at which the support boom 260 projects through the garage door opening 285 when the support boom is locked in place by the support boom locking assembly 256 is thus adjustable. The support boom locking assembly 256 disengages from the support boom 260 by lifting a free end of the hook 257. Lifting a free end of the hook can be performed by moving a release handle 261A in a first handle direction 261B, which in turn rotates a hook pivot pin 259.

Figure 14:
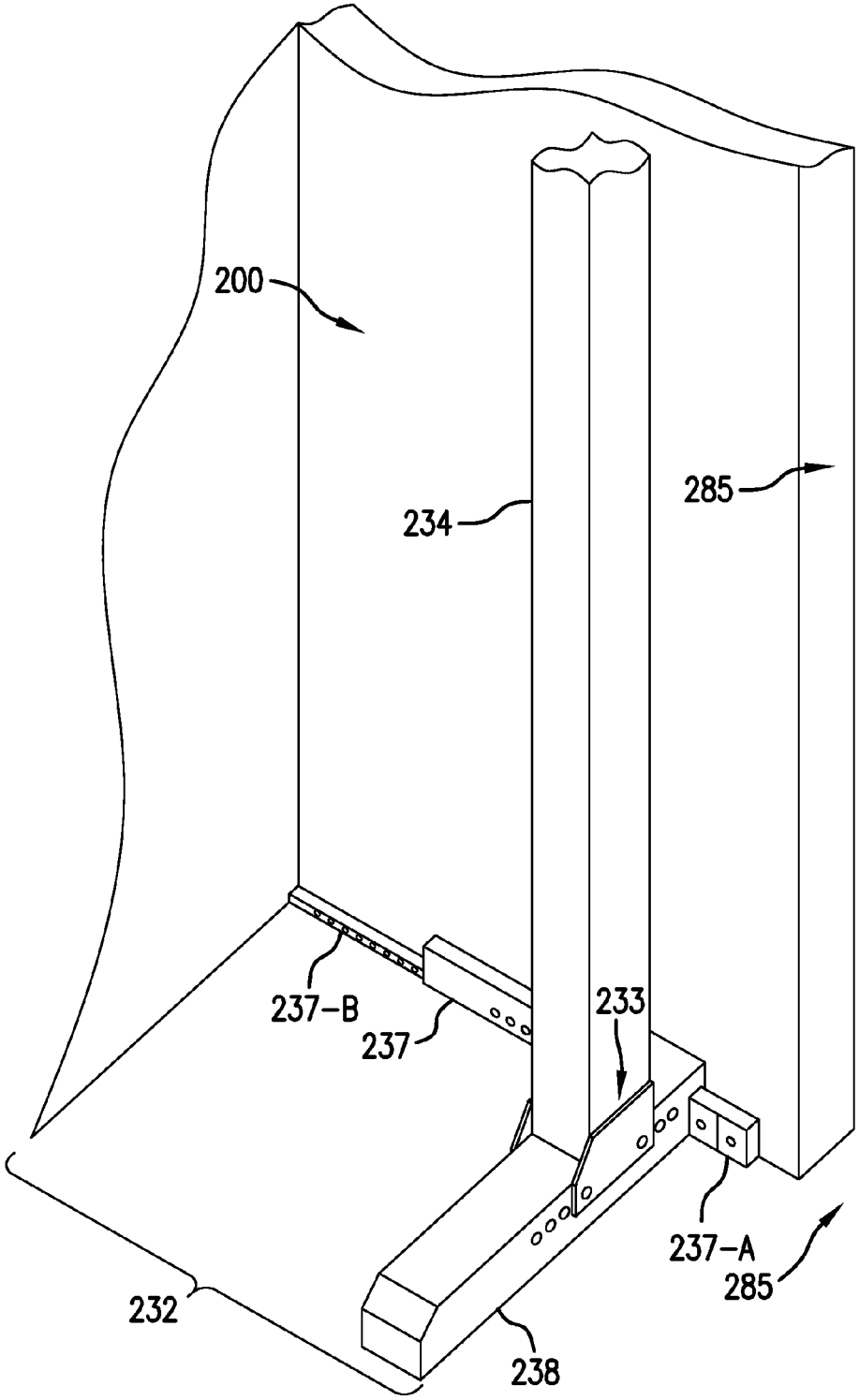
FIG. 14 is a perspective view of a base and tower, installed inside a garage, according to an embodiment.

FIG. 14 shows a base 232 of the second embodiment retractable basketball goal, which comprises a first base leg 237 and a second base leg 238. The tower 234 is coupled directly to the second base leg 238 through an adjustable base coupling 233 that enables attaching the tower 234 to the second base leg at various locations along the length of the second base leg 238. The first base leg 237 can adjustably intersect and extend through the second base leg 238 such that a first base leg projecting portion 237-A projects way from the second base leg 238 toward the garage door opening 285.

The first base leg 237 further includes a leg extension 237-B that extends from the first base leg 237 by an adjustable length. By adjusting how much of the leg extension 237-B extends from within the first base leg 237, the base 232 can be configured to fit garages having varied dimensions. In some embodiments, the first base leg 237 or the first base leg extension 237-B extends to and butts against a garage wall or baseboard. Adjustment of where the first base leg 237 intersects the second base leg 238, and thus how much of the first base leg projecting portion 237-A extends through the second base leg 238, can be utilized to adjust the location of the tower 234 in the garage. Thus by use of the adjustable base coupling 233 and adjustable first and second base leg intersection, position of the tower 234 can be varied or optimized.

Figure 15:
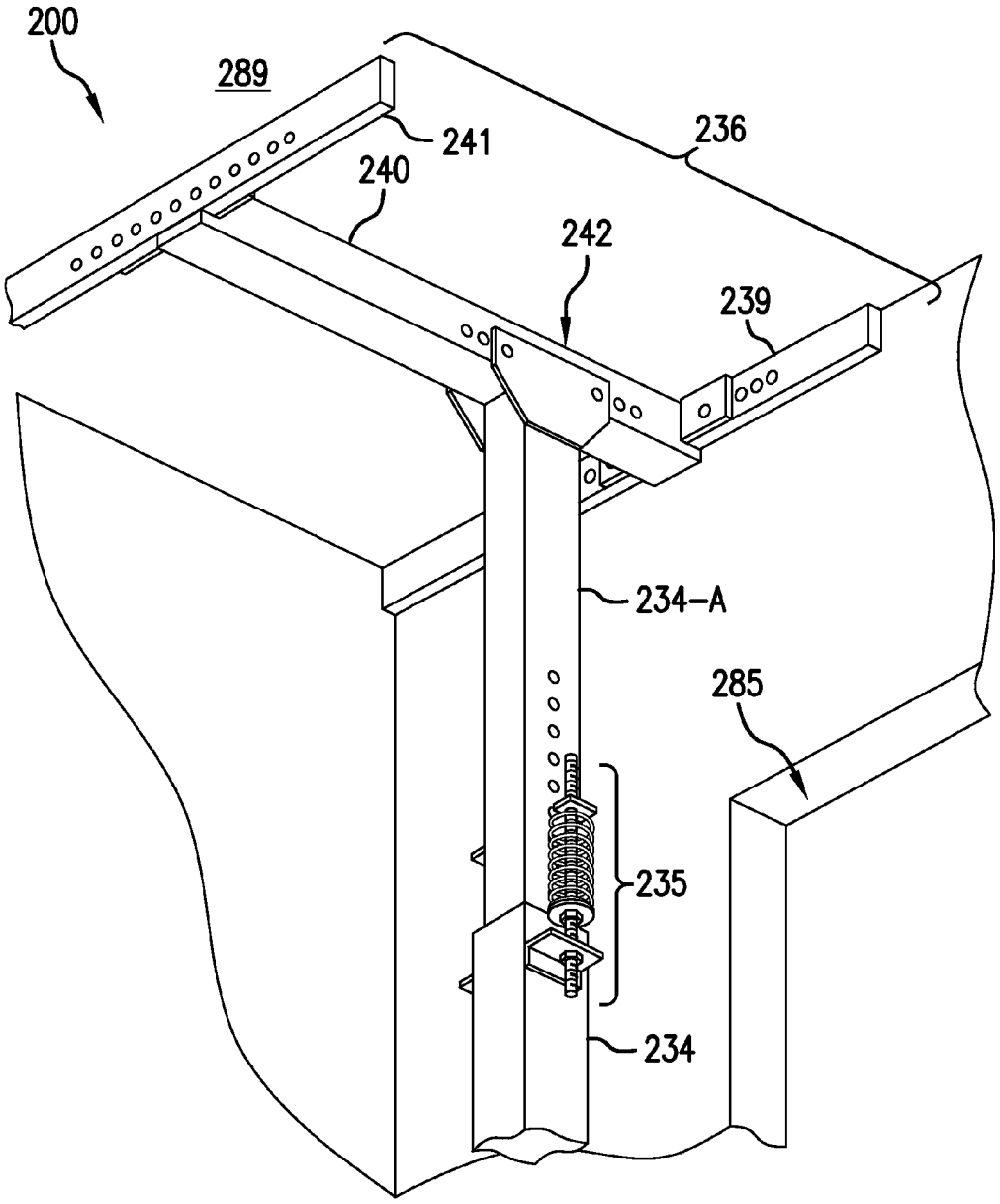
FIG. 15 is a perspective view of a tower, telescopic tower section, and upper brace, installed inside a garage, according to an embodiment.

As best seen in FIG. 15, the anchor assembly of second embodiment retractable basketball goal 200 is height adjustable, with a telescopic tower section 234-A that extends from the tower 234 to the upper brace 236 in order to press the upper brace against the garage ceiling 289. Height adjustability of the second embodiment enables the anchor assembly to wedge in place beneath garage ceilings that fall in a range preferably between 7.0 feet and 14.0 feet, more preferably between 7.0 feet and 10.0 feet, and most preferably approximately 8.0 feet. For exceptionally tall garage ceilings, embodiments included anchor assemblies that are 16.0 feet tall or taller.

The tower 234 includes compression spring couplers 235 configured to press the telescopic tower section 234-A upwardly. An upper brace second arm 240 is affixed directly to the telescopic tower section 234-A with an adjustable brace coupling 242 that enables attaching the telescopic tower section 234-A to the second brace arm 240 at various locations along the length of the arm 240. The upper brace 236 further comprises a first brace arm 239 and a third brace arm 241, both of which are adjustably coupled directly to the second brace arm 240. The adjustable brace coupling 242, along with adjustable coupling of the first and third brace arms 239, 241 to the second brace arm 240, enable positioning the tower 234 at various locations, and complements adjustability of the base 232.

In some embodiments, the anchor assembly does not wedge in place between a garage floor and ceiling. Embodiments include anchor assemblies wherein the tower is received into a receptacle residing in the garage floor. Such floor receptacles can be formed in the garage floor when concrete is poured for the floor, or bored into the concrete later. Embodiments include anchor assemblies that are affixed to floors, walls, or ceilings. Embodiments include anchor assemblies affixed to adjacent structures by fasteners, including but not limited to threaded fasteners. Some embodiments include anchor assemblies anchored in place by use of heavy weights.

Figure 16:
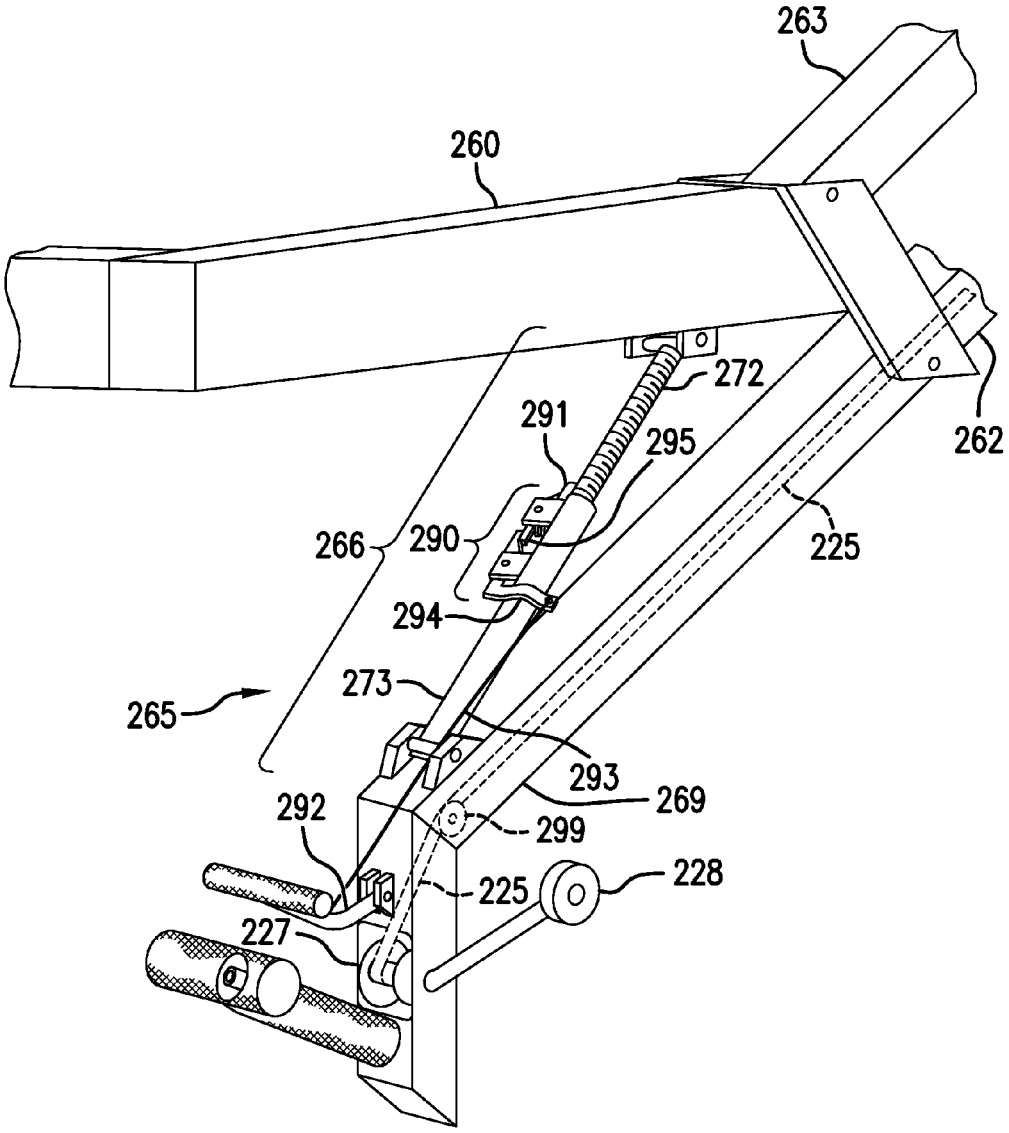
FIG. 16 is a perspective view of a support boom and adjustable strut according to an embodiment.

A second embodiment height adjustment mechanism 265 is illustrated in FIG. 16. The height adjustment mechanism 265 resides below and coupled to the support boom 260, and includes a winch 227 operated by use of a winch crank 228 for adjusting the backboard between vertical and horizontal orientations. The winch 227 is configured to reel in a backboard lift line 225, which is coupled to and acts upon a backboard lift mechanism 216 (see FIG. 17) as previously described for the first embodiment, to raise the backboard to a precisely vertical orientation. The winch 227 is also configured to release the lift line 225, which acts upon the backboard lift mechanism 216 as previously described for the first embodiment, to lower the backboard to a substantially horizontal orientation. The winch 227 further includes a brake to prevent the backboard from inadvertently falling to its horizontal orientation.

The height adjustment mechanism 265 further comprises an adjustable strut 266. The adjustable strut 266 is coupled directly to the first boom arm 262 at one end, and to the support boom 260 at another end. The strut 266 includes a cleat rod section 272 and a receptacle section 273 configured to receive the cleat rod section 272 therewithin. The adjustable strut 266 is thus length adjustable and therefore configured to secure the first boom arm 262 at various positions, which in turn secures the goal assembly at various heights. Shortening the adjustable strut 266 by inserting the cleat rod section 272 farther into the receptacle section 273 allows a proximal end 269 of the first boom arm 262 to rise, which lowers the goal assembly as previously described. Conversely, lengthening the strut 266 by withdrawing the cleat rod section 272 from within the receptacle section 273 allows the proximal end of 269 the first boom arm 262 to lower, which raises the goal assembly as previously described.

The adjustable strut 266 further includes a locking mechanism 290 configured to lock the strut 266 at various lengths. The locking mechanism 290 is installed on the receptacle section 273 and includes a spring actuated wedge mechanism 291 configured to releasably engage the cleated rod 272. Releasing the wedge mechanism 291 from the rod 272 is accomplished by moving a release lever 292, which pulls a release line 293, which in turn pulls an angled lever 294, which in turn presses a lever portion 294 of the wedge mechanism 291 to disengage the wedge mechanism from the cleated rod 272.

Figure 17:
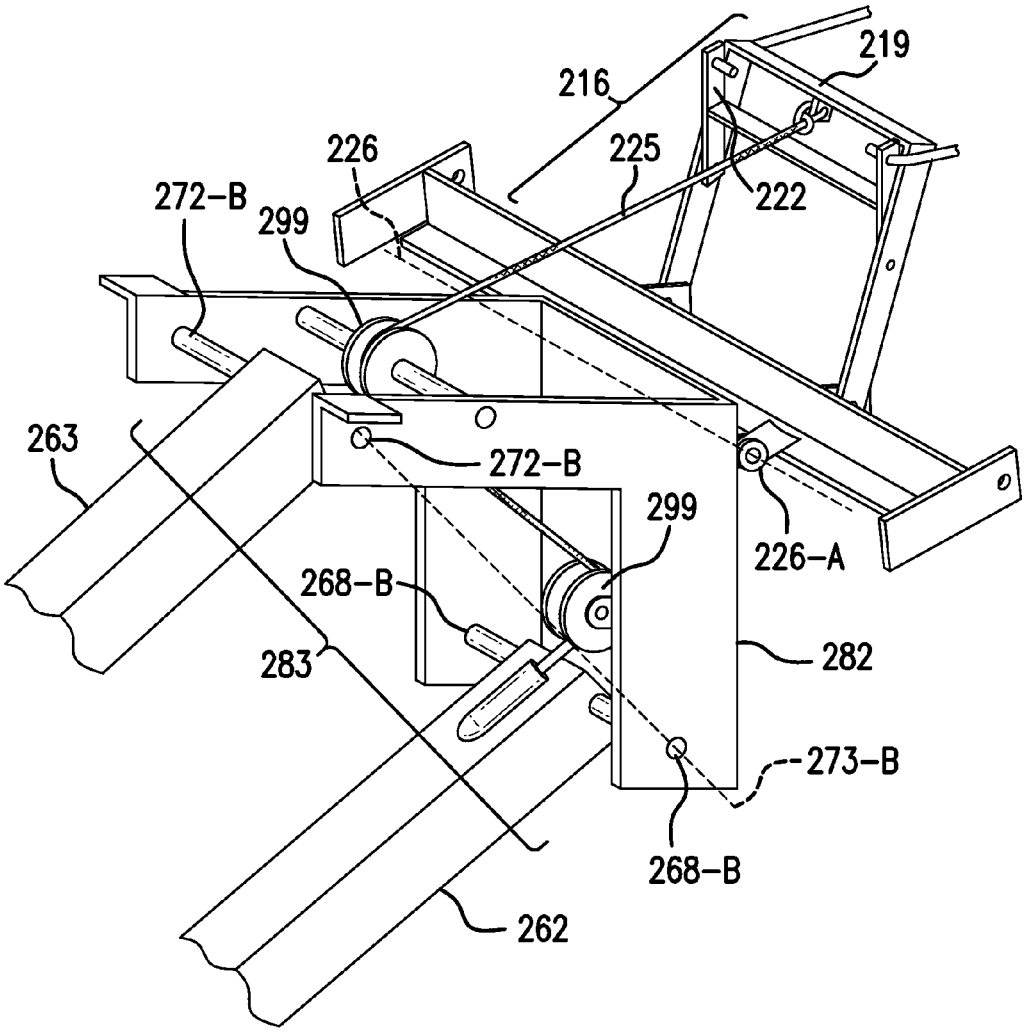
FIG. 17 is a perspective view of a support boom distal end and backboard lift mechanism, according to an embodiment.

As best seen in FIG. 17, the second embodiment retractable basketball goal includes a support boom end member 282 residing at the support boom distal end 283 and coupled directly thereto. A backboard pivot member 226-A resides along the backboard pivot axis 226, and provides a pivotable coupling between the backboard and the support boom end member 282. The support boom end member 282 is coupled directly to the first boom arm 262 at the first boom arm distal pivot member 268-B, and to the second boom arm 263 at the second boom arm distal pivot member 272-B. The boom arm distal pivot pair line 273-B, which the first and second boom arm distal pivot members 268-B, 272-B reside on and are precisely perpendicular to, is shown in FIG. 17 oriented approximately 45° from vertical.

The backboard lift mechanism 216 is shown partially lifted in FIG. 17, with the lift bracket 222 projecting away from the swingarm 219 at approximately 90°. The backboard itself is not shown in FIG. 17. The backboard lift line 225 is shown affixed to and partially lifting the swingarm 222. The second embodiment lift line 225 typically engages idler pulleys 299 to direct the lift line 225 down through an internal hollow of the first boom arm 262 to the winch 227 (see FIGS. 17 and 16). In some embodiments, a backboard lift line runs along and outside of first or second boom arms.

A Method of Using a Retractable Basketball Goal

A method of using a retractable basketball goal according to the present invention typically includes deploying the retractable goal from a retracted configuration to an operational configuration, and subsequently retracting the device from an operational configuration to a retracted configuration.

In a first operation of the method of using a retractable basketball goal, the retractable goal starts in a retracted configuration, in which the entire device resides inside a garage. The retracted configuration typically further includes the goal assembly residing at a clearance height of at least 5.5 feet above the garage floor, with the backboard disposed substantially horizontally. The anchor assembly, to which the goal assembly is coupled by a support boom, typically resides just inside the garage immediately adjacent to a parking space. The parking space is a space of appropriate size and location to receive and house a motor vehicle such as a passenger car or pickup truck inside the garage. Accordingly, the parking space is immediately adjacent to the garage door opening and typically extends at least 15 feet into the garage perpendicular to the garage door opening, and is also typically at least 5.0 feet tall and 7.0 feet wide. The parking space and garage door opening are usually approximately the same width. While in the retracted configuration, a portion of the goal assembly can reside directly above the parking space.

The first operation includes swinging the goal assembly along an arc with the goal assembly passing over the parking space as it revolves around a pivotable coupling by which the support boom is coupled to the anchor assembly. The first operation concludes with the goal assembly residing outside the garage, the anchor assembly remaining in place inside the garage, and the support boom projecting from the anchor assembly, through the garage door opening, to the goal assembly.

In some variations of the first operation, a user may lower the goal assembly slightly before swinging the goal assembly in order to adjust the clearance height from approximately 6.5 feet to approximately 6.0 feet. The goal assembly typically resides in its thinnest configuration (approximately 6.0 inches thick) as it passes over the parking space and through the garage door opening. With the clearance height being approximately 6.0 feet and the thickness of the goal assembly in its thinnest configuration being approximately 6.0 inches, the retractable basketball goal is well suited to passing over a typical passenger car and also passing beneath a typical garage door having a 7.0 feet clearance when open. In some embodiments, the goal assembly is less than 6.0 inches thick in its thinnest configuration, and can thus pass beneath an open garage door with 7.0 feet clearance, even where the goal assembly resides at a clearance height of 6.5 feet. As it revolves around the pivotable coupling, the goal assembly preferably travels along an arc 90°-270°, more preferably 110°-250°, still more preferably 130°-230°, and most preferably about 180°.

A second operation includes raising the goal assembly to a rim height of approximately 10 feet, with the anchor assembly remaining in place inside the garage.

A third operation includes raising the backboard from a substantially horizontal orientation to a precisely vertical orientation. The second and third operations are temporally interchangeable; either operation can be performed before the other. The retractable basketball goal typically resides in an operational configuration at the conclusion of the third operation.

A fourth operation includes lowering the backboard from the precisely vertical orientation to the substantially horizontal orientation.

A fifth operation includes lowering the goal assembly from a rim height of approximately 10 feet to a clearance height of approximately 6.0 feet. The fourth and fifth operations are temporally interchangeable; either operation can be performed before the other.

A sixth operation includes swinging the goal assembly along an arc with the goal assembly passing over the parking space as it revolves around the pivotable coupling, concluding with the goal assembly and the support boom residing entirely inside the garage. The goal assembly typically maintains a clearance height of at least 5.5 feet during the sixth operation, and also passes beneath an open garage door with a clearance of not less than approximately 7.0 feet. In some embodiments, a clearance height of at least 6.5 feet is maintained during the sixth operation. Some garage doors have a clearance of about 8.0 feet when open. The retractable goal assembly typically resides in a retracted configuration when the sixth operation concludes.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

Alternative embodiments include motorized, power actuated, or otherwise automated variations, wherein deployment or retraction of the retractable basketball goal is powered, and thus does not depend on manual operation. In some embodiments, revolution of a support boom around the tower is powered by an electric motor. Similarly, raising or lowering the goal assembly can be powered by an electric motor, as can changing position of the backboard between horizontal and vertical orientations. Variations include pneumatically and hydraulically actuated retractable basketball goals. It is well within the knowledge and ability of a person of ordinary skill in the art to automate or power the retractable basketball device of the present invention, and such automation or powering would require only routine experimentation.

I claim:

1. A retractable basketball goal comprising:

an anchor assembly configured to anchor the retractable basketball goal in place inside a garage;

a goal assembly including a basketball rim coupled to a backboard;

a support boom, wherein the support boom:

couples the goal assembly to the anchor assembly;

is pivotably coupled to the anchor assembly and capable of rotating substantially horizontally around the pivotable coupling; and includes a first boom arm and a second boom arm, wherein the second boom arm is precisely parallel to the first boom arm;

a retracted configuration wherein the backboard is substantially horizontal and the retractable basketball goal is configured to reside entirely within a garage;

an operational configuration wherein:

the backboard is precisely vertical;

the rim is substantially horizontal and resides at a rim height of between 8.0 feet and 10 feet, inclusive; and the goal assembly is configured to reside outside the garage while the anchor assembly resides inside the garage and the support boom projects through a garage door opening; and wherein:

the anchor assembly is configured to remain in place during deployment;

the anchor assembly, the goal assembly, and the support boom are configured to remain coupled together during deployment; and the anchor assembly is securely wedged in place between a garage floor and a garage ceiling, and remains wedged in place during deployment and retraction.

2. The retractable basketball goal of claim 1, wherein the operational configuration further includes the rim height being adjustable in a range from 8 feet to 10 feet.

3. The retractable basketball goal of claim 1, wherein the goal assembly (i) resides at a clearance height in a range from 5 feet to 8 feet, inclusive, when in the retracted configuration, and (ii) is capable of maintaining a clearance height of at least 5.25 feet as the goal assembly deploys or retracts.

4. The retractable basketball goal of claim 1, wherein the goal assembly is configured to revolve at least 90° around the anchor assembly during deployment.

5. The retractable basketball goal of claim 3, wherein the anchor assembly comprises a base and a tower, wherein:

the base resides beneath and provides a stable platform for the tower;

the tower is coupled to the base and projects upwardly therefrom; and the support boom is coupled to the tower and projects laterally therefrom.

6. The retractable basketball goal of claim 1, wherein a height of the anchor assembly is adjustable.

7. The retractable basketball goal of claim 5, wherein the pivotable coupling includes a support boom pivot axis that is offset from the tower and oriented precisely vertically.

8. The retractable basketball goal of claim 7, wherein the support boom further includes a bent arm member residing between the anchor assembly and the first and second boom arms, the bent arm member supporting the first and second boom arms and connecting the first and second boom arms to the anchor assembly.

9. The retractable basketball goal of claim 8, wherein the first and second boom arms are oriented substantially horizontal when in the retracted configuration.

10. The retractable basketball goal of claim 9, wherein the first and second boom arms are oriented between substantially horizontally and substantially vertically when in the operational configuration.

11. A method of using a basketball goal comprising:

deploying a retractable basketball goal assembly from a retracted configuration to an operational configuration, the retractable basketball goal including:

an anchor assembly configured to anchor the retractable basketball goal in place inside a garage;

a goal assembly including a basketball rim coupled to a backboard;

a support boom, wherein the support boom (i) couples the goal assembly to the anchor assembly, (ii) is pivotably coupled to the anchor assembly and capable of rotating substantially horizontally around the pivotable coupling, and (iii) includes a first boom arm and a second boom arm, wherein the second boom arm is precisely parallel to the first boom arm;

a retracted configuration wherein the backboard is substantially horizontal and the retractable basketball goal is configured to reside entirely within a garage; and an operational configuration wherein (i) the backboard is precisely vertical, (ii) the rim is substantially horizontal and resides at a rim height of between 8.0 feet and 10 feet, inclusive, and (iii) the goal assembly is configured to reside outside the garage while the anchor assembly resides inside the garage and the support boom projects through a garage door opening;

wherein (i) the anchor assembly is configured to remain in place during deployment, (ii) the anchor assembly, the goal assembly, and the support boom are configured to remain coupled together during deployment, and (iii) the anchor assembly is securely wedged in place between a garage floor and a garage ceiling, and remains wedged in place during deployment and retraction.

12. The method of claim 11, wherein:

the garage includes a garage door opening at least 7.0 feet wide and at least 7.0 feet tall, and a garage parking space residing inside the garage and immediately adjacent to the garage door opening, the garage parking space being at least 5.0 feet tall, 7.0 feet wide, and extending at least 15 feet into the garage perpendicular to the garage door opening; and the anchor assembly resides inside the garage and outside the garage parking space.

13. The method of claim 12, wherein said deploying further comprises:

revolving the goal assembly at least 90° around the anchor assembly;

passing the goal assembly over the garage parking space; and passing the goal assembly through the garage door opening.

14. The method of claim 13, wherein:

the retractable basketball goal further includes a height adjustment mechanism; and said deploying further comprises, with the height adjustment mechanism residing inside the garage, using the height adjustment mechanism to adjust the goal assembly to a rim height of between 8.0 feet and 10 feet.

15. The method of claim 13, wherein:

the retractable basketball goal further includes a backboard lift mechanism; and said deploying further comprises operating the backboard lift mechanism from inside the garage to raise the backboard from a substantially horizontal orientation to a precisely vertical orientation.

* * * * *